US005343711A

United States Patent [19]

Kornhauser et al.

[11] Patent Number: 5,343,711

[45] Date of Patent: Sep. 6, 1994

[54] METHOD OF REDUCING FLOW METASTABILITY IN AN EJECTOR NOZZLE

[75] Inventors: Alan A. Kornhauser; Peter Menegay, both of Blacksburg, Va.

[73] Assignee: Virginia Tech Intellectual Properties, Inc., Blacksburg, Va.

[21] Appl. No.: 118

[22] Filed: Jan. 4, 1993

[51] Int. Cl.[5] ..... F25B 1/06

[52] U.S. Cl. ..... 62/116; 62/500; 62/511; 417/198

[58] Field of Search ..... 62/116, 191, 500, 511; 417/151, 182, 187, 198

[56] References Cited

U.S. PATENT DOCUMENTS 1,836,318 12/1931 Gay ..... 62/116

2,140,306 12/1938 Beals ..... 62/116 X 2,676,470 4/1954 Streitz ..... 62/511

4,324,112 4/1982 Fujiwara et al. ..... 62/511

4,810,170 3/1989 Ide ..... 417/198 X

*Primary Examiner*—Harry B. Tanner

*Attorney, Agent, or Firm*—Charles J. Brown

[57] ABSTRACT

A method of reducing flow metastability in a liquid refrigerant in an ejector nozzle by generating dispersed bubbles in the flow entering the nozzle by first forming relatively large bubbles and then breaking them down into small finely dispersed bubbles, so as to reduce the density of the flowing mixture and provide nucleation sites allowing control of flow rate and causing the mixture to expand in substantial thermodynamic equilibrium with maximum nozzle velocity.

3 Claims, 1 Drawing Sheet

METHOD OF REDUCING FLOW METASTABILITY IN AN EJECTOR NOZZLE

BACKGROUND OF THE INVENTION

Ejector-expansion refrigeration cycles are known to involve the replacement of a conventional expansion valve with a work-producing jet ejector to reduce the enthalpy of the refrigerant entering the evaporator and provide work to assist in the operation of the compressor. An example is disclosed in U.S. Pat. No. 3,277,660. In the basic ejector-expansion refrigeration cycle the high-pressure liquid refrigerant leaving the condenser is utilized as the ejector motive nozzle fluid for partially compressing the saturated vapor leaving the evaporator.

A liquid-vapor mixture exits from the ejector at a pressure between the evaporator pressure and the compressor discharge pressure. The liquid portion of this flow is returned to the evaporator while the vapor portion enters the compressor suction. In essence the result is a two-stage refrigeration system wherein the work which would otherwise be lost in the high-stage expansion process provides the work input for the low stage.

Controls for the ejector-expansion refrigeration cycle are described in U.S. Pat. Nos. 3,670,519 and 3,701,264. In the first of these, it is proposed that flow through the ejector motive nozzle be controlled by mixing vapor from the compressor discharge with the liquid entering the motive nozzle. The procedure is intended to reduce flow by reducing density of the inlet fluid. In the second, it is proposed that the ejector motive nozzle be fitted with a spindle to reduce nozzle cross-sectional area while maintaining a smooth area variation. This procedure is intended to reduce flow by reducing cross-sectional area. Both these procedures avoid throttling the liquid refrigerant before it enters the motive nozzle.

In recent experimental programs with ejector-expansion refrigeration cycles it has been noted that ejector performance is impaired by metastable conditions of the refrigerant in the ejector nozzle. In the rapid expansion of the gas-free liquid refrigerant flashing from the ejector nozzle, boiling is delayed by lack of nucleation sites. Surface tension results in pressures above saturation within the tiny bubbles that result from random molecular motions and as a consequence these bubbles do not grow. The only available nucleation sites are those provided by crevices in the wall of the ejector tube and hence the flow consists of an annulus of vapor surrounding a core of metastable liquid refrigerant. The refrigerant exiting from the nozzle is therefore not in thermodynamic equilibrium and its enthalpy decrease and kinetic energy increase are considerably less than they would be if the refrigerant were in thermodynamic equilibrium. For example, if saturated liquid R-12 at 140 psia is expanded to 40 psia in an isentropic equilibrium process the nozzle outlet velocity is approximately 280 feet per second. On the other hand if the R-12 refrigerant expands isentropically as a metastable liquid which is not in a state of thermodynamic equilibrium the nozzle outlet velocity is only about 100 feet per second. Since kinetic energy is proportional to the square of velocity the kinetic energy in the non-equilibrium condition is only 13 percent of that in the equilibrium condition.

A principal object of the present invention is to reduce the metastability of the refrigerant flow in an ejector nozzle to approximate as closely as possible an equilibrium condition so that the exiting refrigerant achieves maximum nozzle velocity.

SUMMARY OF THE INVENTION

The method of the invention is applicable to an ejector process wherein a pressurized liquid flows through and partially flashes to vapor upon exiting from an ejector nozzle. The ejector process may be part of a refrigeration cycle or other process such as a water desalination system, a condenser in a space power system or in a geothermal energy plant. Flashing flow nozzles utilizing the process of the invention may also function in atomizing, spray drying, fuel injection or other applications.

The method of the invention achieves reduction in flow metastability. It comprises generating dispersed bubbles in the liquid flow within the nozzle by first forming relatively large bubbles and then breaking them down into small finely dispersed bubbles, thereby reducing the density of the flowing mixture and providing boiling nucleation sites which cause the exiting mixture to expand in substantial thermodynamic equilibrium with maximum nozzle velocity. Flow control is accomplished in the first step of generation of relatively large bubbles.

In one form of the invention the relatively large bubbles are generated by forcing the liquid through a flow-restricting orifice or control valve in a relatively large diameter portion of the ejector nozzle and the small bubbles are thereafter generated by passing the flowing mixture through a relatively small diameter portion of the ejector nozzle. In another form of the method the relatively large bubbles are generated by introducing pressurized gas into the liquid flowing through the nozzle.

The generation of the relatively large bubbles by the use of an orifice or control valve reduces the pressure of the flowing refrigerant to slightly below its saturation pressure so as to result in boiling. Since the density of the vapor is very much less than the density of the liquid, a very small proportion of vapor by mass will result in a large decrease in mixture density. By this reduction in density, the flow through the motive nozzle can be greatly reduced even though the pressure reduction through the orifice or control valve is only a small fraction of that available to the motive nozzle.

The vapor leaving the orifice or control valve is in the form of large bubbles or slugs. The breakup and dispersion of the large bubbles is affected by passing the flow through a tube of small diameter. This diameter is much smaller than would be used for normal transport of the refrigerant, but larger than that of the ejector motive nozzle throat. In this tube the high flow velocity results in a high level of turbulence, which breaks up and finely disperses the bubbles. The length of the tube should be adequate for this process to take place.

In some applications it is possible to achieve both large bubble generation and bubble breakup in one small diameter tube. In these cases the pressure decrease due to acceleration at the tube entrance and friction within the tube is adequate to reduce the refrigerant pressure below its saturation pressure. In essence, this is a combination of orifice and tube in which the orifice and tube diameters are identical.

In other applications it may be appropriate to eliminate the orifice or control valve and generate bubbles by addition of vapor from the compressor discharge, as described in U.S. Pat. No. 3,670,519. Such an arrangement would combine that bubble generation with the means of bubble breakup and dispersion described here. It would avoid the problem of metastability in the nozzle, but would not avoid the performance penalty due to gas bypassing the condenser.

DESCRIPTION OF PREFERRED EMBODIMENT

Figure 1:
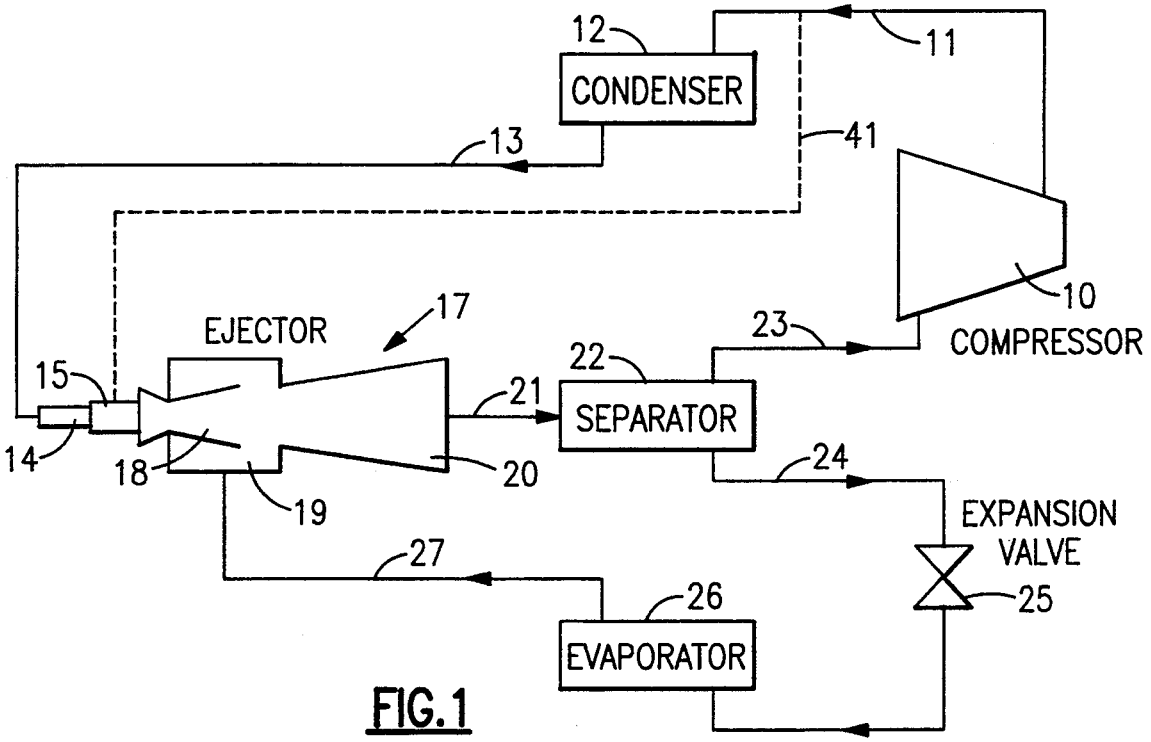
FIG. 1 is a schematic diagram illustrating a typical ejector-expansion refrigeration cycle to which the method of the invention is applicable.

Referring first to FIG. 1, a typical ejector-expansion refrigeration cycle system is shown which includes a compressor 10 from which a vapor phase refrigerant such as R-12 is delivered under pressure in a line 11 to a condenser 12 where it undergoes a phase change to liquid. The high-pressure liquid refrigerant from the condenser 12 proceeds through a line 13, through a large bubble generating device 14 connected to a bubble dispersion and size reduction device 15. Forms of the devices 14 and 15 are described hereinafter. The refrigerant passes through a jet ejector 17, also described in more detail hereinafter, wherein the pressurized liquid refrigerant is utilized as the ejector motor fluid. A liquid-vapor mixture exits at high velocity from a nozzle 18 of the ejector 17. It then mixes with and accelerates vapor entering through an ejector suction 19. The resulting liquid-vapor mixture is then slowed and compressed in an ejector diffuser 20 and is conveyed through a line 21 to a separator 22. Vapor from the separator 22 proceeds through a line 23 to the suction side of the compressor 10. Liquid from the separator 22 proceeds through a line 24 through an expansion valve or other throttling device 25 wherein its pressure is reduced. The liquid then proceeds to an evaporator 26 where it undergoes a phase change to vapor and is directed back through a line 27 to the ejector suction 19. The liquid-vapor phase exiting the ejector diffuser 20 in the line 19 is at a pressure between that in the line 27 from the evaporator 26 and that in the line 11 from the compressor 10. The pressure of the liquid refrigerant is reduced in the expansion valve or other throttling device 25 by the same amount that the pressure of the two-phase refrigerant is increased by the ejector 17 between the lines 27 and 21.

Without the bubble-generating device 14 and the bubble dispersion device 15 the refrigerant expanding in the ejector motive nozzle 18 would be metastable and not in a state of thermodynamic equilibrium. Flow through the ejector motive nozzle 18 under those conditions would consist of an annulus of vapor surrounding a core of metastable liquid refrigerant due to minimal nucleation sites for dispersed boiling. The kinetic energy of the liquid-vapor mixture leaving the nozzle 18 would then be considerably less than if the fluid were in a state of thermodynamic equilibrium. As a result the pressure increase between lines 27 and 21 due to the use of the ejector would be considerably less. It will be understood that large unevenly dispersed bubbles contribute nothing to solving the problem of metastability.

The method of the invention reduces flow metastability as the pressurized liquid refrigerant flows through and partially flashes to vapor upon exiting from the ejector motive nozzle 18. This is achieved by one of the methods illustrated schematically in FIGS. 2, 3 and 4. The bubble generator 14–15 in FIG. 1 schematically represents any one of the FIGS. 2 to 4 embodiments. In the FIG. 2 method of achieving bubbly flow seeding in the ejector motive nozzle 18 the liquid in a saturated or subcooled state enters from a relatively large diameter section 30 corresponding to the line 13 in FIG. 1. It then passes through a flow restrictive orifice 35 corresponding to the bubble generating device 14 in FIG. 1.

The throttling action of the orifice 31 causes the refrigerant to become a liquid-vapor mixture with much lower average density than the pure liquid. The vapor in the mixture leaving the orifice is in the form of large bubbles and slugs. This liquid-vapor mixture then passes through a small diameter section 32 corresponding to the bubble dispersion device 15 of FIG. 1. The high velocity turbulent flow in the section causes the large bubbles and slugs to break up into many small finely dispersed bubbles. This mixture then enters the typical converging/diverging nozzle 33 corresponding to the nozzle 18 in FIG. 1. The small diameter section 32 need not immediately follow the relatively large diameter section 30, and in the example shown the orifice 31 is located further upstream in the relatively large diameter section 30. The size and dispersion of the bubbles can be varied by varying the length and diameter of the small diameter section 32. The small diameter section 32 may also be curved, providing the diameter is decreased so that the increased turbulence overcomes the liquid-vapor separation effects of the curvature.

Figure 3:
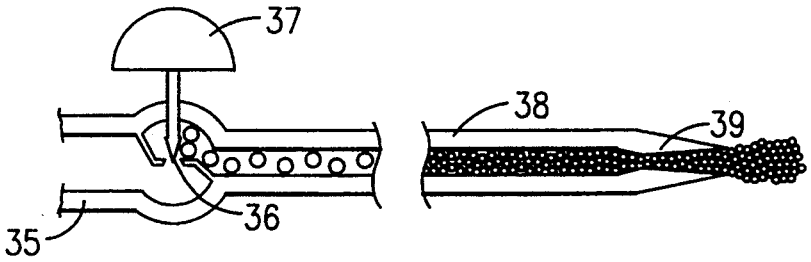
FIG. 3 is an illustration similar to FIG. 2 wherein the orifice is part of a control valve.

In the FIG. 3 method a larger section 35 includes an orifice 36 in which an adjustable control valve 37 operates. The larger bubbles generated in the orifice 36 are broken down in a smaller section 38 and the mixture exits through a nozzle 39.

Figure 4:
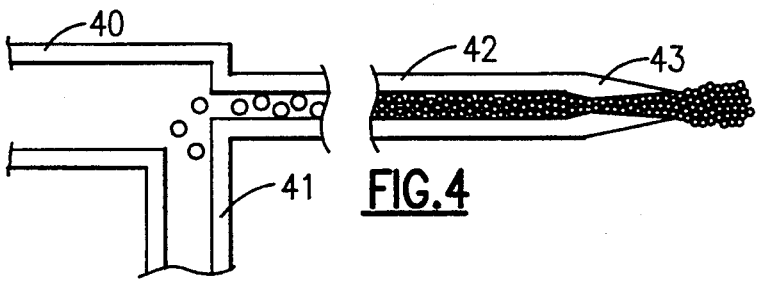
FIG. 4 is a schematic illustration of the method for generating bubbles and controlling flow rate by introducing a gas into the liquid refrigerant and reducing the bubble size by passing the refrigerant through a small diameter tube.

In the FIG. 4 method of achieving bubbly flow in the ejector motive nozzle 18 the liquid in a saturated or subcooled state also enters from a relatively large diameter section 40 corresponding to line 13 of FIG. 1. It then mixes with a gas, namely uncondensed refrigerant vapor, entering through another relatively large diameter section 41 shown as a dotted line in FIG. 1 extending from the discharge side of the compressor 10. The result of this mixing is a liquid-vapor mixture with much lower average density than the pure liquid. The vapor in the liquid-vapor mixture is in the form of large bubbles and slugs. These are then broken up and dispersed in a smaller section 42 by the identical methods shown in FIGS. 2 and 3. The mixture exits through a nozzle 43.

Experiments have been conducted with ejector-expansion refrigeration cycles wherein the bubble generator is of transparent material and the formation of the bubbles may be viewed during operation. As noted previously the bubbles provide nucleation sites to enhance uniformly dispersed and complete boiling of the refrigerant as it flashes out of the ejector, thereby closely approximating ideal thermodynamic equilibrium conditions which achieve the largest decrease in enthalpy and thus the largest increase in outlet kinetic energy, which means of course the highest possible nozzle outlet velocity and the greatest contribution of work to assist in powering the compressor.

These same experiments have shown that the ejector motive nozzle flow is substantially reduced by introduction of bubbles into the stream. When these bubbles are produced by the throttling technique of FIGS. 2 or 3, the refrigeration system performance penalty due to the pressure drop in the throttle is small. When these bubbles are produced by the mixing techniques illustrated in FIG. 4, the performance penalty due to compressing and expanding gas without condensing it is considerably larger.

Figure 2:
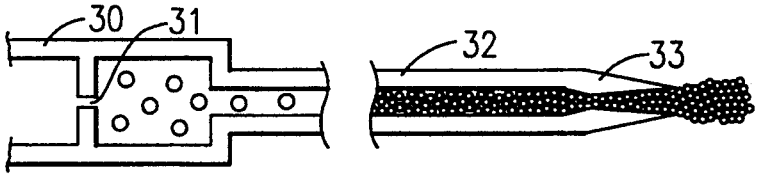
FIG. 2 is a schematic illustration of the method of generating bubbles by forcing the refrigerant through a flow restricting orifice and reducing the size of these bubbles therefore by passing the refrigerant through a small diameter tube.

In one example of the FIG. 2 method of the invention wherein the relatively large bubbles were formed by forcing the refrigerant through an orifice 31 upstream of a relatively small diameter bubble dispersion section 32, the refrigeration system was of three-quarter ton capacity and the refrigerant was R-12. The evaporating pressure was 45 psia and the condensing pressure was 160 psia. Liquid subcooling was at 7.4° F. The relatively large diameter section 30 was 0.315 inch inside diameter and the orifice 31 was of 0.046 inch diameter. The relatively small diameter section 32 was 8 inches in length and 0.08 inch in inside diameter. The inside diameter of the ejector nozzle 33 was 0.036 inch. The ejector discharge pressure was 47 psia and the ratio of ejector motive flow to suction flow was 1.25.

The design of the bubble generation and dispersion means is fairly insensitive to changes in evaporator and condenser pressures. The diameters of the relatively large and relatively small sections and of the orifice will vary approximately in proportion to the square root of system size and approximately in proportion to the inverse square root of liquid refrigerant density. The orifice diameter will increase for smaller subcooling and decrease for larger subcooling, and of course it would be reduced in order to throttle the system. The length-to-diameter ratio of the relatively small diameter section in which the small finely dispersed bubbles are generated may be expected to remain constant for different design conditions but there can be considerable variation in the selection of this ratio. The proportion of the total pressure rise produced in the ejector as well as the suction-to-motive-flow ratio can be expected to remain fairly constant at different conditions.

The scope of the invention is to be determined not by the foregoing description of preferred embodiments but rather by the following claims.

We claim:

1. In an ejector process wherein a pressurized fluid flows initially as a liquid through a relatively large diameter first portion of an ejector nozzle and thereafter partially flashes to vapor upon exiting from a relatively small diameter diverging portion of the nozzle, a method of achieving reduction in flow metastability which comprises a) generating relatively large bubbles in the initial liquid flow of the liquid within the relatively large diameter first portion of the ejector nozzle, b) thereafter directing the fluid through a second portion of the ejector nozzle having a diameter substantially less than that of said first portion and an extended length so that the flow within said second portion is of sufficient velocity and duration to break the large bubbles into finely dispersed small bubble before the fluid reaches and exits from the diverging portion of the nozzle, c) thereby reducing the density of the flowing mixture and providing boiling nucleation sites which cause the exiting mixture to expand in substantial thermodynamic equilibrium with maximum nozzle velocity.

2. A method according to claim 1 wherein the length of the second portion of the ejector nozzle is at least approximately one hundred times its own minimum diameter.

3. A method according to claim 1 wherein the relatively large bubbles are generated by forcing the fluid through a flow restricting orifice in the relatively large diameter first portion of the ejector nozzle.

* * * * *